US005477870A

United States Patent [19]

Menaged

[11] Patent Number: 5,477,870

[45] Date of Patent: Dec. 26, 1995

[54] BARRETTE

[75] Inventor: Neal M. Menaged, South Hampton, Pa.

[73] Assignee: Lewis M. Hendler, Huntingdon Valley, Pa.

[21] Appl. No.: 255,452

[22] Filed: Jun. 8, 1994

[51] Int. Cl.[6] ..... A45D 8/22

[52] U.S. Cl. ..... 132/279; 132/278

[58] Field of Search ..... 132/278, 279, 132/273, 277, 275, 276; D28/39, 40, 41, 42, 43

[56] References Cited

U.S. PATENT DOCUMENTS

| | | | |
|---|---|---|---|
| 565,207 | 8/1896 | Hock . | |
| 717,499 | 12/1902 | Gouy | 132/275 X |
| 2,352,529 | 6/1944 | Frankel | 132/275 |
| 2,495,504 | 1/1950 | Behr . | |
| 2,699,789 | 1/1955 | Goodman . | |
| 2,851,040 | 9/1958 | Sell, Jr. . | |
| 3,565,084 | 2/1971 | Vulliard . | |
| 3,704,717 | 12/1972 | Morand et al. . | |
| 3,805,813 | 4/1974 | Laughton | 132/279 |
| 3,881,501 | 5/1975 | Kleine . | |
| 5,062,436 | 11/1991 | Emsellem . | |
| 5,154,196 | 10/1992 | Moffat | 132/278 |
| 5,335,680 | 8/1994 | Moore | 132/276 |
| 5,355,899 | 10/1994 | Kuo-Hua | 132/279 |

FOREIGN PATENT DOCUMENTS

| | | | |
|---|---|---|---|
| 552698 | 12/1959 | Belgium | 132/279 |
| 370792 | 3/1923 | Germany | 132/279 |
| 1097630 | 1/1961 | Germany | 132/279 |
| 3541608 | 11/1986 | Germany | 132/278 |

*Primary Examiner*—John G. Weiss
*Attorney, Agent, or Firm*—Harness, Dickey & Pierce

[57] ABSTRACT

A double sided barrette having a pair of support members, a clasp, a hair gripping mechanism and a pair of decorative members is provided. The pair of support members are coupled to one another by a hinge such that the support members can pivot between open and closed positions. When in a closed position, the clasp operably engages these support members and maintains them in a releasably fixed relationship with respect to one another. The hair gripping mechanism is disposed between the support members such that strands of hair engaged by the gripping mechanism are spaced from the support members. The decorative members are individually attached to the support members in order to conceal the support members and provide an ornamental appearance to both sides of the barrette.

17 Claims, 3 Drawing Sheets

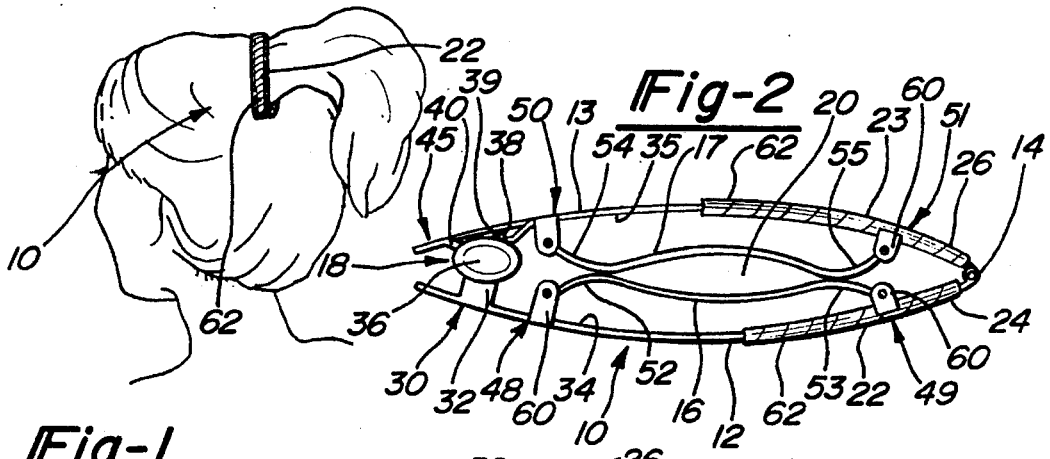
Fig-2
Fig-1
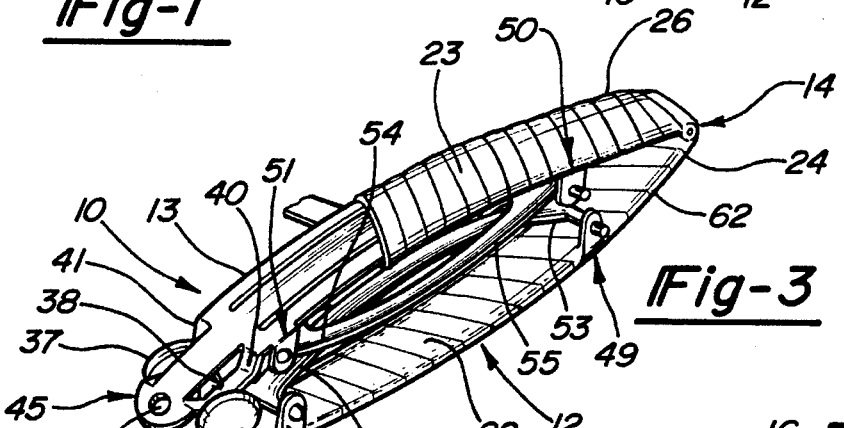
Fig-3
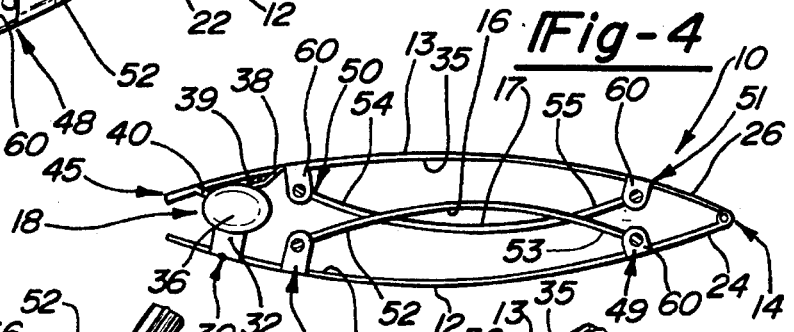
Fig-4
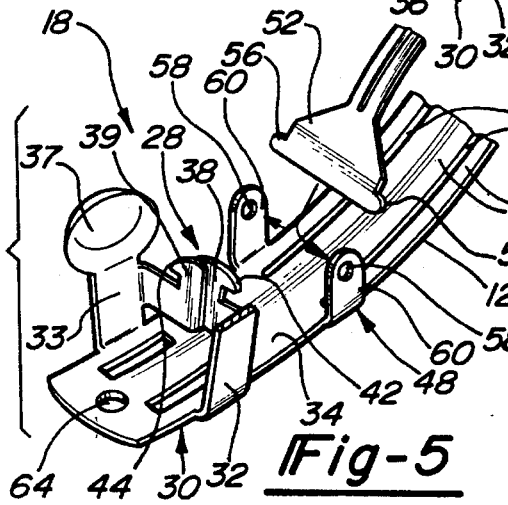
Fig-5
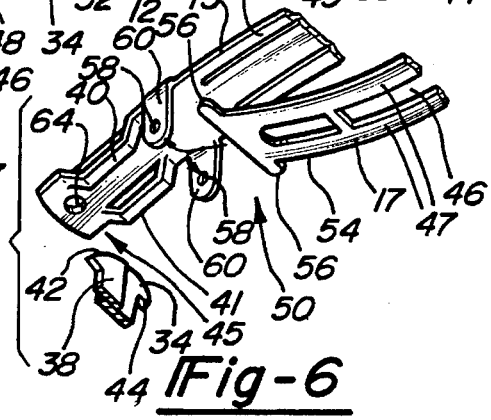
Fig-6

BARRETTE

BACKGROUND OF THE INVENTION

1. Technical Field

The present invention generally relates to barrettes and, more particularly, to a double sided barrette adapted for readily receiving various types of decorative members on both sides thereof.

2. Discussion

Generally, barrettes or "hair slides" are decorative clips which are used to retain braided or gathered strands of hair. One particular type of barrette includes a locking member, an inner retaining member and an outer support member with a decorative member secured thereto. Quite typically, the outer support member and the locking member are hinged to one another for pivotal movement and can be locked in a closed position by a clasp. As such, this type of barrette is placed over the strands of hair such that the decorative member is outwardly exposed and the locking member is tucked underneath the strands of hair. The locking member and outer support member are then pivoted to a closed position such that the strands of hair are clampingly engaged between the inner retaining member and the locking member. Accordingly, the decorative member is maintained in an outwardly facing direction and serves as a fashion item which enhances the appearance of the barrette and its user.

One drawback to these types of barrettes is that they must be properly oriented with respect to the strands of hair such that the locking member is concealed. Locking members are generally not made of a decorative material and therefore limit the orientation of the barrette to a singular position where the decorative member is outwardly displayed. In order to avert this drawback, double sided barrettes have been created, however, these types of barrettes are generally more costly, thereby decreasing desirability within the marketplace. Moreover, decorative members for double sided barrettes often directly engage the strands of hair being held, causing the decorative members to deflect or distort when clamping too much hair, and slip when not clamping enough hair. Another drawback to these types of barrettes is that they can be time consuming to assemble. Typically, barrettes are fully assembled before the decorative members are affixed. Thus, in order to secure the decorative member to the outer support member, the inner retaining member must usually be removed first. Removal of the inner retaining member is a time consuming step which complicates, and increases the cost of, manufacturing.

Thus, it would be desirable to provide a barrette that is double sided such that it can be oriented in any position without exposing an unfinished surface. It would also be desirable to provide a barrette which is adapted to readily receive a number of variously styled decorative members without having to disassemble the barrette. Further yet, it would be desirable to provide a hair gripping mechanism that properly engages gathered strands of hair of varying thicknesses without causing the decorative members to deflect or distort and without permitting the barrette to slide out of place when the gathered strands of hair are not particularly thick. In addition, it would be desirable to provide such a barrette with a minimum number of parts which can be easily assembled to reduce costs.

SUMMARY OF THE INVENTION

In order to overcome the aforementioned disadvantages and fulfill these desirable features, the double sided barrette of the present invention is provided. This double sided barrette includes a pair of outer support members that are pivotally coupled to one another such that the support members can pivot between open and closed positions. In the closed position, a clasp operably engages both support members and maintains them in a releasably fixed relationship with respect to one another. When in this releasably fixed relationship, the support members define an opening for housing a hair gripping mechanism. A portion of the hair gripping mechanism is spaced from the support members such that the hair clamped within the hair gripping mechanism does not engage the support members. As a result, the clamped strands of hair do not deflect or distort the decorative members affixed to the support members. The hair gripping mechanism is also adapted to grip a small amount of gathered strands of hair without sliding out of place. Moreover, the hair gripping mechanism can be adapted to articulate with respect to the support members such that decorative members can be readily attached to the support members without completely removing the hair gripping mechanism. Thus, the outer surfaces of both support members can be easily concealed, permitting the barrette to be oriented in any position without exposing an unfinished surface of the barrette.

DETAILED DESCRIPTION OF THE DRAWINGS

Additional objects, advantages, and features of the present invention will become apparent from the following description and appended claims, taken in conjunction with the accompanying drawings in which:

FIG. 1 is a perspective view of a person wearing the double sided barrette of the present invention in a substantially vertical position;

FIG. 2 is a front view of the double sided barrette of FIG. 1 illustrating flexible inner members clampingly engaging strands of hair;

FIG. 3 is a perspective view of a double sided barrette arranged in accordance with the principles of the present invention and illustrated in a closed position;

FIG. 4 is a front view of the barrette of FIG. 1 in a closed position with decorative members removed to better illustrate the underlying structure of the barrette;

FIG. 5 is a perspective view of a clasp of the barrette of FIG. 1;

FIG. 6 is a perspective view of the inner flexible members operatively engaged with portions of the outer support members in accordance with the principles of the present invention;

DETAILED DESCRIPTION OF THE PREFERRED EMBODIMENT

Figures 7, 8:
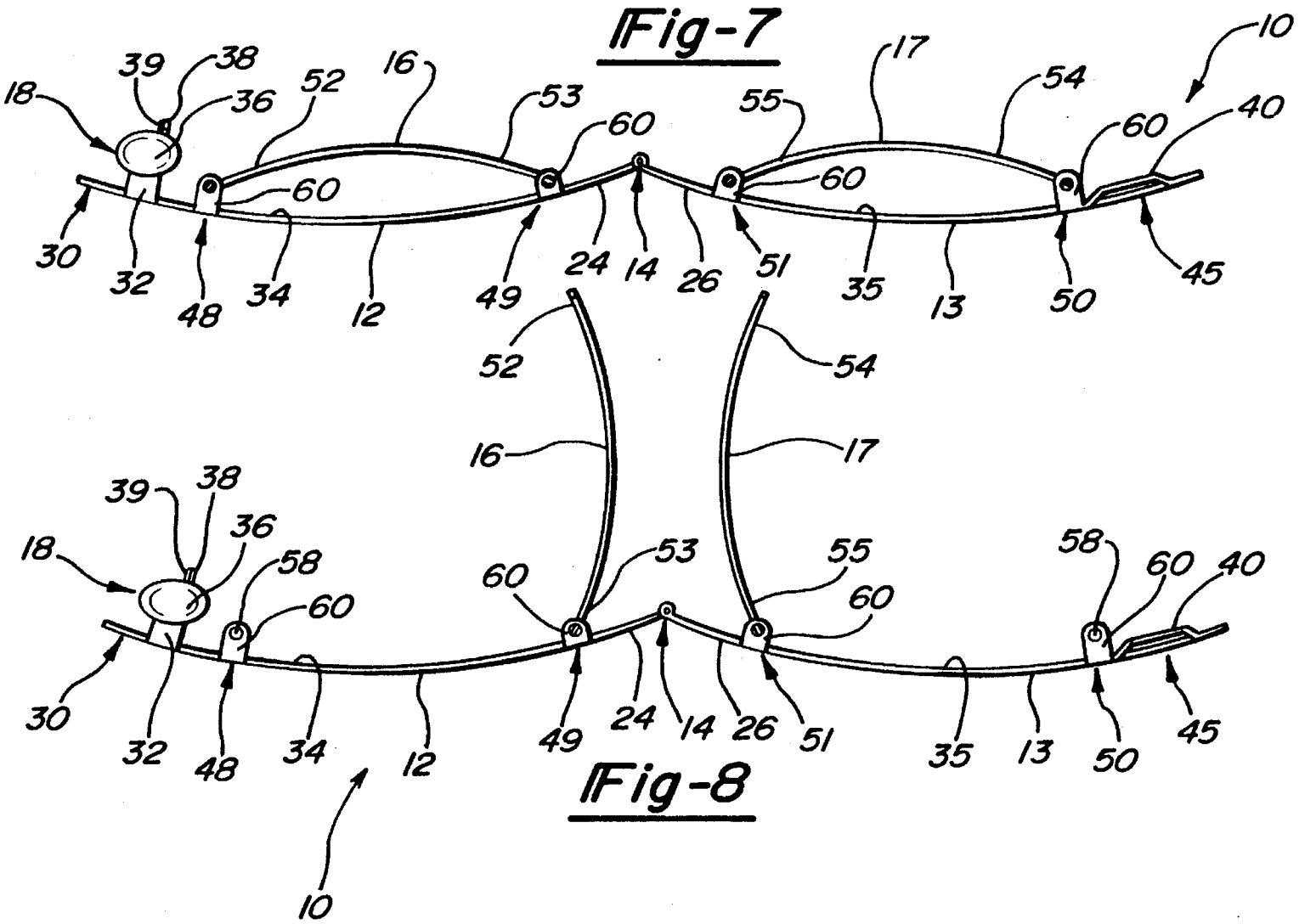
FIG. 7 is a front view of the barrette of FIG. 1 in an open position with decorative members removed to better illustrate the underlying structure of the barrette.
FIG. 8 is a front view similar to FIG. 3 illustrating the flexible inner members in an open condition, with one end of each of the flexible inner members articulated away from the outer support members such that a decorative member can be readily affixed to the outer support members.
Figure 9:
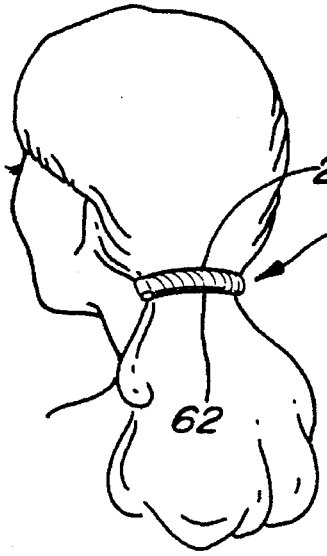
FIG. 9 is a perspective view of a person wearing the double sided barrette of the present invention in a horizontal position.

Referring now to the drawings and in particular to FIGS. 1, 2 and 3, the double sided barrette 10 of the present invention is shown. As shown in FIG. 1, this particular barrette 10 is preferably worn in a position where both outer surfaces 62 of the barrette 10 are visible. Thus, the barrette 10 may be worn in a substantially vertical position as shown in FIG. 1 or in a horizontal position (not shown), however, the barrette 10 may also be worn in a position where only one of the outer surfaces 62 is exposed, as shown in FIG. 9. In any event, the barrette 10 includes two outer support members 12 and 13 that are pivotally coupled to one another by a conventional hinge 14. The barrette 10 also includes a pair of inner flexible members 16 and 17 and a clasp 18, both of which are operatively associated with each of the outer support members 12 and 13. As depicted in FIGS. 2 and 7, when the outer support members 12 and 13 are rotated about the hinge 14 from an open position, shown in FIG. 7, to a closed position, shown in FIGS. 2 and 3, the inner flexible members 16 and 17 clampingly engage strands of hair 20. As is shown, the inner flexible members 16 and 17 engage the strands of hair 20 such that the strands 20 are spaced from the outer support members 12 and 13 and, therefore, from a pair of decorative members 22 and 23 affixed to the outer support members 12 and 13. In addition, the inner flexible members 16 and 17 can be readily articulated to an open condition as shown in FIG. 8. In this condition, a wide variety of decorative members 22 and 23 can be readily affixed to or received by the outer support members 12 and 13 which openly extend from the hinge 14. Accordingly, the double sided barrette 10 of the present invention can be more easily manufactured with a minimal number of parts and therefore resulting in cost efficiencies over existing technology.

As shown in the embodiment depicted in FIGS. 2, 4 and 7, the outer support members 12 and 13 of the barrette 10 are relatively rigid elongated arcuate members which are pivotally coupled to one another at distal ends 24 and 26 by the conventional hinge 14. This hinge 14 allows the outer support members 12 and 13 to pivot with respect to one another in a clam shell like manner as shown in FIGS. 4 and 7. When closed, the outer support members 12 and 13 are maintained in a releasably fixed relationship with respect to one another by clasp 18. As best shown in FIG. 5, this clasp preferably employs a double acting latch portion 28 that extends upwardly from one end 30 of one of the support members 12. The double acting latch portion 28 includes a pair of spring-like support tabs 32 and 33 that extend perpendicularly from an inner surface 34 of one of the support members 12. The support tabs 32 and 33 each support release buttons 36 and 37 such that each of the release buttons 36 and 37 are in an apposing relationship with respect to one another. Latch pawls 38 and 39 extend inwardly from each of the release buttons 36 and 37 such that the latch pawls are parallel and slidingly engage one another when the release buttons 36 and 37 are depressed.

When the outer support members 12 and 13 are pivoted to a closed position, each of the latch pawls 38 and 39 engage individual latch plates 40 and 41 which extend from an end 45 of the opposing support member 13. As shown in FIGS. 3 and 5, when ramped surfaces 42 and 44 on each of the latch pawls 38 and 39 engage a corresponding latch plate 40 and 41, the spring-like support tabs 32 and 33 are cammed toward one another. As a result, the latch pawls 38 and 39 ride over the latch plates 40 and 41 and lockingly engage therewith. In order to release this locking engagement, the release buttons 36 and 37 are simply depressed, thereby moving the latch pawls 38 and 39 inwardly and out of engagement with the latch plates 40 and 41. Thereafter, the outer support members 12 and 13 can be pivoted to an open position where the spring like support tabs 32 and 33 return the release buttons 36 and 37 to a normal condition.

As shown in FIG. 2, when the outer support members 12 and 13 are in a closed position, the inner flexible members 16 and 17 clampingly engage strands of hair 20. Inner flexible members 16 and 17 are generally arcuate and, in a preferred embodiment, span a portion of the concave inner surfaces 34 and 35 of the support members 12 and 13. When operatively engaged with strands of hair 20, members 16 and 17 act as a hair gripping mechanism which holds the strands of hair 20 in place and maintains the barrette 10 in the proper orientation. The inner flexible members 16 and 17 have spring-like characteristics and therefore when deflected upon engagement with even the smallest gathered strands of hair 20, the inner flexible members 16 and 17 are loaded and exert a reactive gripping force against the strands of hair 20.

In order to assist this gripping action, a number of parallel grooves 46 and bands 47 are provided on each of the flexible members 16 and 17, as shown in FIGS. 3 and 6. As further shown in FIGS. 3 and 4, when the barrette 10 is in a closed position, and the inner flexible members 16 and 17 are not engaged with strands of hair 20, these parallel grooves 46 and bands 47 intermesh with one another. As a result, when strands of hair 20 are not engaged, the inner flexible members 16 and 17 are prevented from engaging and loading one another, however, when the inner flexible members 16 and 17 engage even a small amount of hair, they are loaded and a reactive gripping force is exerted.

As best shown in FIG. 6, the inner flexible members 16 and 17 operatively engage the outer support members 12 and 13 through pivotal couplings 48, 49, 50 and 51. Preferably, the distal tips 52, 53, 54 and 55 of each of the flexible members 16 and 17 have transversely extending projections 56 with the projections 57 at ends 53 and 55 of flexible members 16 and 17 being elongated. These projections 56 are operable for engagement with eyelets 58 in retaining tabs 60. These retaining tabs 60 extend from the inner surfaces 34 and 35 of support members 12 and 13 and, as best shown in FIG. 8, pivotally receive the projections 56. Thus, as shown in FIG. 8, the inner flexible members 16 and 17 can be articulated with respect to the outer support members 12 and 13 by simply sliding two of the shorter projections 56 out of the eyelets 58, and pivoting the flexible members 16 and 17 about the elongated projections 57.

Figure 10:
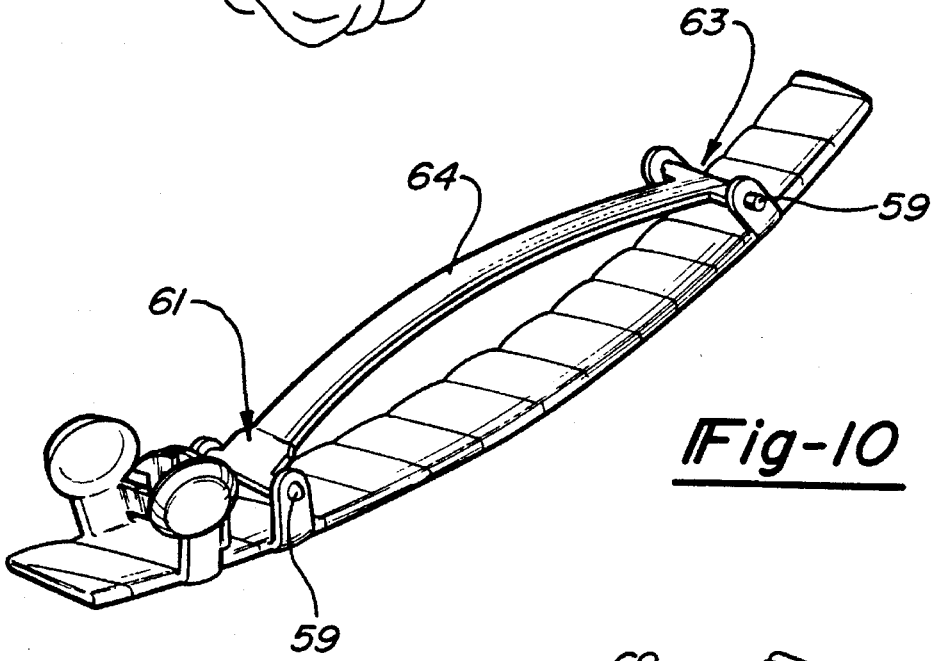
FIG. 10 is a perspective view of a portion of the double sided barrette illustrating an alternate embodiment of one of the hinge constructions of the present invention.
Figure 11:
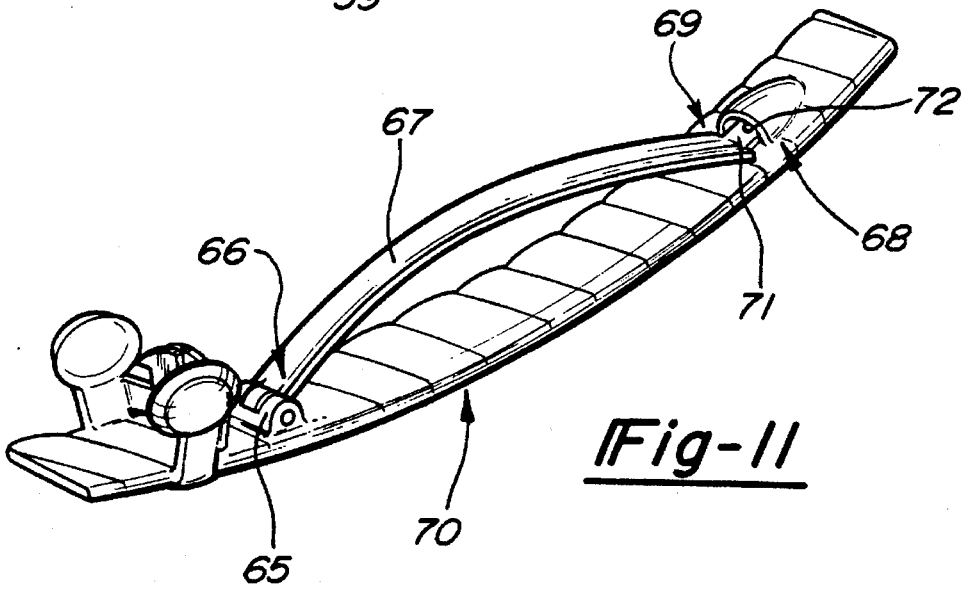
FIG. 11 is a perspective view similar to FIG. 10 illustrating yet another embodiment of the hinge construction of the present invention.

FIGS. 10 and 11 depict alternative embodiments of the pivotal coupling between the outer support members 12 and 13 and the inner flexible members 16 and 17. As shown in the embodiment of FIG. 10, projections 59 extend from both ends 61 and 63 of the inner flexible member 64 and are of the same length. Thus, the inner flexible member 64 can be detached at either end 61 or 63 and pivoted about the opposite end 63 or 61 respectively, or can be easily detached at both ends 61 and 63. The construction shown in FIG. 11 illustrates a conventional hinge 65 at one end 66 of the inner flexible member 67 and a tongue and groove arrangement 68 at the other end 69. The inner flexible member 67 is free to pivot about the hinge 65 and can be fixed with respect to the outer support member 70 by inserting a tongue 71 at one end 69 of the inner flexible member 67 into a groove 72 in the outer support member 70. Thus, with either embodiment, the inner flexible members 16 and 17 can be articulated away from the outer support members 12 and 13 to permit decorative members 22 and 23 to be easily attached thereto.

Regardless of the embodiment used, one end 52, 53, 54 or 55 of each of the flexible members 16 and 17 can be detached and articulated generally away from the support members 12 and 13 such that the support members 12 and 13 openly extend from the hinge 14 without being obstructed by the inner flexible members 16 and 17. This unique feature of the barrette 10 of the present invention allows any number of decorative members 22 and 23 to be readily attached to the outer support members 12 and 13. Alternatively, both ends of the flexible members 52, 53, 54 and 55 can be detached from the outer support members 12 and 13 in the event that complete detachment of the inner flexible members is desirable. As noted, this is most easily accomplished when the embodiment depicted in FIG. 10 is utilized.

By articulating the inner flexible members away from the outer support members, a pliable material such as a fabric, flexible plastic, or the like can be easily wrapped around the outer support members 12 and 13 to provide a decorative appearance to the outer surfaces 62 of the barrette 10. Once this material is in place, the inner flexible members 16 and 17 are simply articulated to a closed position, as shown in FIG. 3. Thereafter, the transversely extending projections 56 are snapped into engagement with the eyelets 58, thereby locking the inner flexible members 16 and 17 in place. Likewise, rigid decorative members 22 and 23 such as wood, plastic, metal, leather, porcelain, clay or the like are more readily affixed to the support members 12 and 13 when the inner flexible members 16 and 17 are articulated to an open, non-obstructing position. FIG. 3 illustrates that apertures 64 can be provided in the support members 12 and 13 for assisting in attaching these types of decorative members 22 and 23 thereto. For example, a rigid decorative member 22 or 23 can be attached to the support members 12 and 13 by passing a fastener such as a screw, staple, strip of Velcro® or the like (not shown) through the aperture 64 and into engagement with the decorative member 22 or 23.

When manufacturing or using the barrette 10 of the present invention, decorative members 22 and 23 can be readily applied by either the manufacturer or the end user. In either case, the inner flexible members 16 and 17 are simply articulated to a non-obstructing position such that the decorative members 22 and 23 are readily received by the support members 12 and 13. Thus, it is possible to provide a single barrette frame having a number of variously styled decorative members 22 and 23 that can be readily affixed to the barrette 10 in a standard manner.

Hence, a wide variety of ornamental appearances can be provided for the barrette 10 of the present invention. Moreover, since decorative members 22 and 23 are affixed to both of the outer support members 12 and 13, the barrette 10 of the present invention is not positionally limited. No matter how the barrette 10 is oriented, all unfinished surfaces of the barrette 10 remain concealed by the decorative members 22 and 23. Furthermore, the inner flexible members 16 and 17 permit strands of hair 20 to be engaged by the barrette 10, spaced from the decorative members 22 and 23. As a result, the decorative members 22 and 23 are prevented from deflecting or distorting when a large amount of hair is engaged, and from slipping when a small amount of hair is engaged. Thus, the double sided barrette 10 provides a unique cost effective alternative to single sided barrettes through a number of unique features and advantages.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A barrette comprising;

a pair of support members having inner and outer surfaces and first and second ends, first ends of each of the support members being coupled to one another by a hinge device such that the support members can pivot between opened and closed positions, and when in the closed position, the inner surfaces are shaped to define an opening therebetween;

a clasp operable for engaging the pair of support members when in the closed position such that the support members are maintained in a releasably fixed relationship with respect to one another;

a hair gripping mechanism for gripping strands of hair and adapted to be disposed within the opening and spaced from the inner surfaces when in the closed position; and a pair of decorative members, each being individually attached to a respective one of the outer surfaces such that the outer surfaces of the support members are generally concealed and such that when the support members are in the closed position, the decorative members provide an ornamental appearance to the barrette;

wherein said hair gripping mechanism comprises a pair of elongated flexible members, both ends of each of said flexible members being operatively associated with one of said support members such that said flexible members each span a portion of one of said support members and are capable of articulating with respect to said support members, thereby allowing at least one end of each of said flexible members to articulate generally away from said support member to permit attachment of said decorative members to said support members.

2. The barrette of claim 1 wherein the inner surfaces of the support members are generally concave.

3. The barrette of claim 1 wherein a portion of said pair of decorative members is disposed between said support members and said flexible members.

4. The barrette of claim 1 wherein said pair of decorative members comprises a pair of elongated pliable members which are wrapped around said support members such that said support members are concealed.

5. The barrette of claim 1 wherein said support members each have at least one aperture extending therethrough, said aperture providing means for attaching said decorative members to said support members.

6. The barrette of claim 1 wherein said supporting members are operable for receiving one of a plurality of decorative members.

7. The barrette of claim 1 wherein said decorative members are made of a fabric material.

8. The barrette of claim 1 wherein said decorative members are made of wood.

9. The barrette of claim 1 wherein said decorative members are made of plastic.

10. A double sided barrette apparatus comprising:

a) a pair of elongated members, said elongated members being pivotally coupled to one another at one end by a hinge such that said elongated members can pivot between opened and closed positions;

b) a clasp affixed to an end of one of said elongated members spaced from said hinge for operable engagement with an end of said other elongated member spaced from said hinge, said clasp operable for maintaining said elongated members in a held relationship with respect to one another when in said closed position;

c) a pair of elongated flexible members for grippingly engaging strands of hair, each end of both of said flexible members being operatively associated with one of said elongated members such that said flexible members each span a portion of one of said elongated members and are capable of articulating with respect to said elongated members, thereby allowing one end of each of said flexible members to articulate generally away from said elongated member to permit attachment of an object to said elongated member; and d) a pair of decorative members attached to said elongated members.

11. The double sided barrette apparatus of claim 10 wherein a portion of each of said decorative members is disposed between one of said elongated members and one of said flexible members.

12. The double sided barrette apparatus of claim 10 wherein said pair of elongated members are relatively rigid arcuate members which are configured such that when in said closed position, concave surfaces on said elongated members are juxtaposed thereby defining a generally elliptical opening.

13. The double sided barrette apparatus of claim 10 wherein said pair of decorative members comprise a pair of pliable members, each of said pliable members being wrapped around one of said elongated members thereby generally concealing said elongated members and providing a decorative appearance for said elongated members.

14. The double sided barrette apparatus of claim 10 wherein each of said elongated members has at least one aperture therein operable for attaching said pair of decorative members to said elongated members.

15. The double sided barrette apparatus of claim 10 wherein said decorative members are made of a fabric material.

16. The double sided barrette apparatus of claim 10 wherein said decorative members are made of wood.

17. The double sided barrette apparatus of claim 10 wherein said decorative members are made of plastic.

* * * * *